United States Patent [19]

Weagle

[11] 4,055,124

[45] Oct. 25, 1977

[54] FOLDING TRAINING TABLE

[75] Inventor: James A. Weagle, Tupelo, Miss.

[73] Assignee: Krueger Metal Products, Inc., Green Bay, Wis.

[21] Appl. No.: 740,907

[22] Filed: Nov. 11, 1976

[51] Int. Cl.[2] ..... A47B 3/00

[52] U.S. Cl. ..... 108/132; 248/439

[58] Field of Search ..... 108/129, 131–134; 211/182; 248/188.6, 439; 403/65, 83

[56] References Cited

U.S. PATENT DOCUMENTS

| | | | |
|---|---|---|---|
| 538,748 | 5/1895 | Schroder et al. | 108/131 X |
| 1,959,725 | 5/1934 | Lindsay | 108/132 |
| 3,628,471 | 12/1971 | Burr | 108/132 |

*Primary Examiner*—James C. Mitchell

*Attorney, Agent, or Firm*—Henry C. Fuller

[57] ABSTRACT

A folding table having a modesty panel employs a locking mechanism in the form of tab and hook assemblies to rigidify the table in the unfolded operative condition with the legs erect and the modesty panel in a position for use. The tab and hook assemblies are mounted on the panel and the tabs are received in slots in the adjacent leg assemblies to prevent hinged movement of the leg assemblies about their hinge axis. The hooks are rotatably and slidably supported in apertures in the tabs and are movable between a folded position and a leg embracing position. In the leg embracing position the hooks secure the tabs in the slots by preventing hinged movement of the panel.

3 Claims, 4 Drawing Figures

Fig. 1
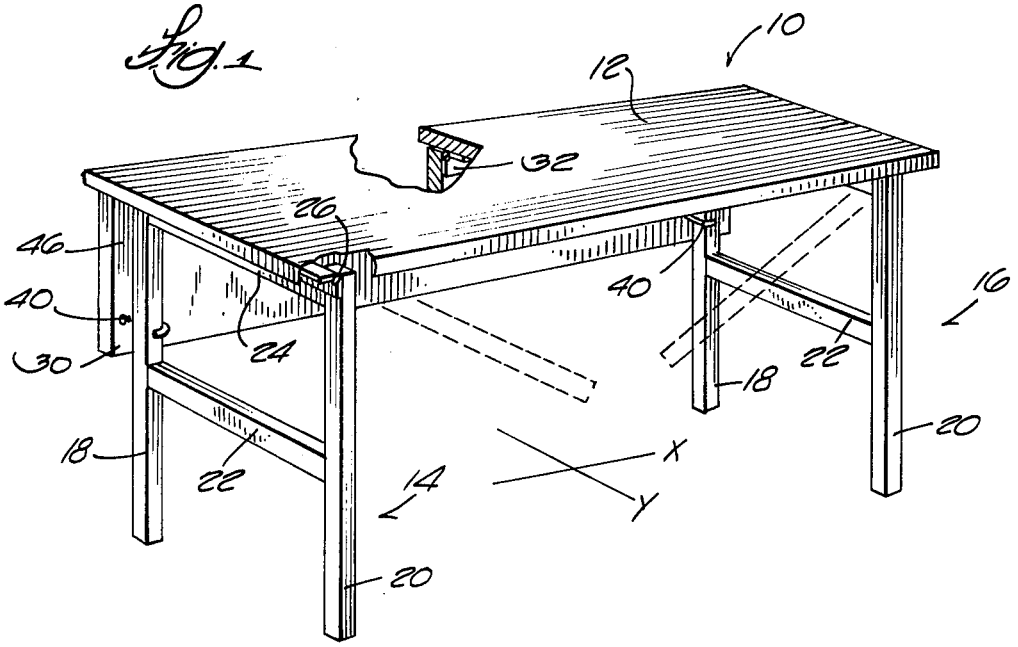
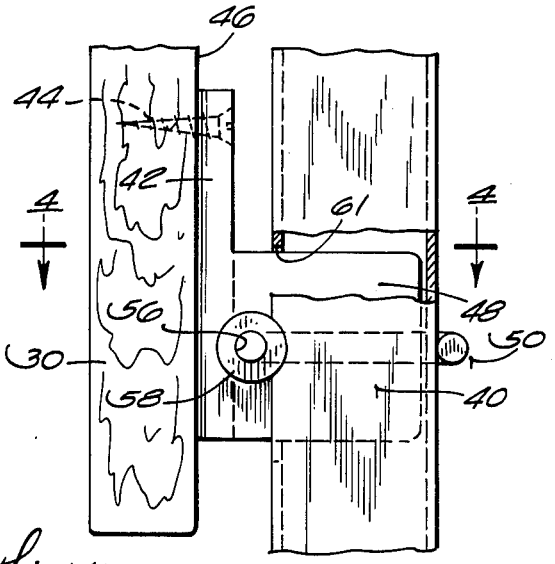
Fig. 3
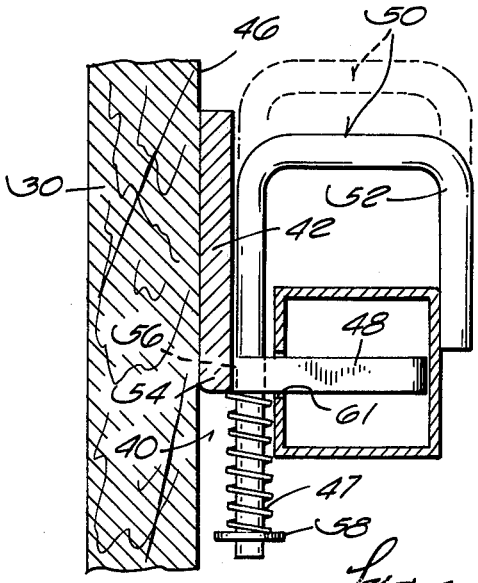
Fig. 4
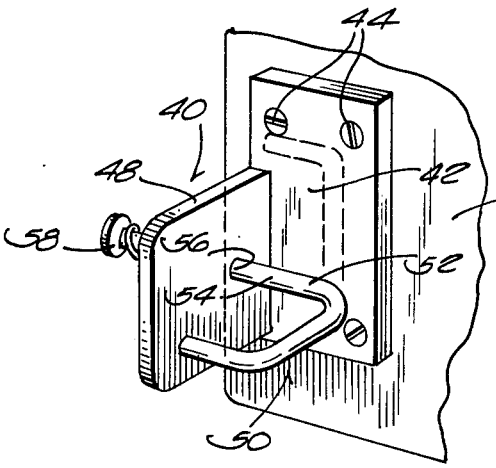
Fig. 2

FOLDING TRAINING TABLE

SUMMARY OF INVENTION

The invention provides a locking mechanism for securing the legs and a modesty panel of a folding table in the erect unfolded position. Tables of this general type are disclosed in U.S. Pat. No.3,628,471. The locking mechanism of the invention includes two tab and hook assemblies each mounted on the panel and adjacent one of the two leg assemblies. Each leg assembly includes two interconnected legs which are hinged to the undersurface of the table top for hinged movement about an axis transverse to the longitudinal extent of the table between the unfolded and folded condition against the bottom of the table top.

The modesty panel is hinged along an axis parallel to the longitudinal extent of the table and can be folded over the legs when the legs are collapsed against the undersurface of the table top. The legs adjacent the panel are provided with slots which receive tabs carried by the undersurface of the panels when the panel is moved to the unfolded position for use. The tabs carry hook members which have a shank portion which is slidable through and supported in a hole in the tab with the hook members being shiftable through the hole between a clearance position with the leg and a leg embracing position. A spring arranged around the shank of the hook and bearing against the tab and an abutment on the end of the hook shank biases the hook into the leg embracing position. When the tab on the panel is inserted in a slot in the leg and the hook member is in the leg embracing position, neither the leg assemblies nor the panel can pivot about their hinges and thus the table is maintained in the upright erect unfolded condition. Disengagement of the mechanism is accomplished by manually pushing on the free end of the hook shank to release the hook from the leg to enable the legs to be hinged to the folded position and the panels folded over the legs for storage.

Further objects and advantages of the invention will become apparent from the disclosure.

DESCRIPTION OF DRAWINGS

FIG. 1 is a perspective view of a table employing the tab and hook assemblies of the invention.

FIG. 2 is an enlarged perspective view of a tab and hook assembly shown in FIG. 1.

FIG. 3 is a fragmentary enlarged end view of a tab and hook assembly engaged with a table leg as shown in FIG. 1.

FIG. 4 is a view of lines 4—4 of FIG. 3.

DESCRIPTION OF PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

FIG. 1 shows a table 10 which has a top 12 and two leg assemblies 14 and 16. Each leg assembly includes legs 18 and 20 which are interconnected by a stretcher 22 and an apron 24. The aprons 24 are hinged to the undersurface of the table top by hinges 26 so that the legs can be folded about axes parallel to the Y axis beneath the table top and flush against the table top bottom for storage purposes. The table also includes a modesty panel 30 which is hinged by hinge 32 to the undersurface of the table top for swinging movement about an axis parallel to the X axis.

In accordance with the invention, there is provided a tab and hook assembly 40 to secure each of the leg assemblies 14 and 16 and the panel 30 in the unfolded position shown in full lines in FIG. 1. As best illustrated in FIG. 2, each tab and hook assembly 40 includes a mounting plate 42 which is secured by fasteners 44 to the undersurface 46 of the modesty panel 30. A tab 48 is integrally formed with the mounting plate 42 and extends along the Y axis as shown in FIG. 4. A hook 50 has a generally U-shaped portion 52 and a shank portion 54 which extends through an aperture 56 in the tab 48 and is rotatably and slidably supported in the aperture 56 for rotatable and sliding movement about the X axis. Biasing means in the form of a spring 47 arranged around the shank 54 located between the tab 48 and abutment 58 which biases the hook to the leg embracing position around the leg 18 as shown in full lines in FIG. 4.

To lock the table leg assemblies 14, 16 and panel 30 in the usable position shown in full lines in FIG. 1, the leg assemblies 14, 16 are unfolded about the Y axis to a position at right angles with the table top. The panel 30 is then swung about its hinge 32 so that the tabs 48 register in vertically extending slots 61 in the legs 18. The hooks 50 are then swung from their folded condition (FIG. 2 in broken lines) generally parallel with the panel 30 while also being pushed to the clearance position as shown in broken lines in FIG. 4. The hooks 50 are released and their springs pull the hooks into the full line position shown in FIG. 4. The hooks prevent unfolding of the panel by release of the tabs 48 from the slots 61 in the legs and thus prevent unfolding of the leg assemblies about their hinged connections with the table top. To fold the table the shanks 54 of the hooks 50 can be either pressed from outside the leg assemblies to push the hook into the clearance positon or the hook can be grasped manually by reaching through the leg assemblies to remove the hook and swing the hook to the folded position free of the legs.

I claim:

1. A table having a top with a longitudinal X axis and a transverse Y axis said table having ends and sides, leg assemblies hingedly connected to said top adjacent the ends thereof for pivotal movement about a Y axis between folded and unfolded positions, a side panel hingedly connected to a side edge of said table for movement about the X axis between a folded and unfolded position, and means for connecting said panel to said leg assemblies to maintain the leg assemblies and panel in the unfolded erect position, said means including an opening in each leg assembly open along the Y axis and facing laterally outwardly of the top along the Y axis, projections on said panel registrable with said leg openings when the panel and leg assemblies are in the unfolded position, said projections preventing movement of said leg assemblies about said hinged connection to the top, said means further including hooks shiftable along the X axis between a leg clearance position and a leg embracing position with said hooks preventing movement of said panel to the unfolded position and disengagement of the projections when said hooks are in the leg embracing position, and wherein said hooks are supported in apertures in said projections and said hooks are rotatable about an axis parallel to the X axis to afford folding of the hook against the panel.

2. A table in accordance with claim 1 including biasing means to urge said hooks to the leg embracing position.

3. A table having a top with ends and sides, leg assemblies hingedly connected to said top adjacent the ends thereof for pivotal movement between folded and unfolded positions, a side panel hingedly connected to a side edge of said table for movement between a folded and unfolded position, and means for connecting said panel to said leg assemblies to maintain the leg assemblies and panel in the unfolded erect position, said means including an opening in each leg assembly facing laterally outwardly of the top and facing the panel, projections on said panel registrable with said leg openings when the panel and leg assemblies are in the unfolded position, said projections preventing movement of said leg assemblies about said hinged connection to the top, said means further including hooks on said panel and shiftable between a leg clearance position in a plane parallel with the side panel and a leg embracing position with said hooks extending transverse to said panel locking said legs to said panel and preventing movement of said panel to the unfolded position and disengagement of the projections when said hooks are in the leg embracing position.

* * * * *